US005345492A

United States Patent [19]

Weaver, Sr. et al.

[11] Patent Number: 5,345,492

[45] Date of Patent: Sep. 6, 1994

[54] ROTATING ANODE X-RAY TUBE

[75] Inventors: John D. Weaver, Sr., Barrington; Thomas J. Muchowicz, Elk Grove Village; Arkady Kantor, Buffalo Grove; George L. Awad, Schaumburg, all of Ill.

[73] Assignee: Eureka X-Ray Tube Corp., Arlington Heights, Ill.

[21] Appl. No.: 177

[22] Filed: Jan. 4, 1993

[51] Int. Cl.[5] ..... H01J 35/10

[52] U.S. Cl. ..... 375/125; 378/127; 378/144

[58] Field of Search ..... 378/125, 121, 127, 128, 378/129, 131, 132, 143, 144

[56] References Cited

U.S. PATENT DOCUMENTS

| | | | |
|---|---|---|---|
| 2,121,632 | 6/1938 | Gross et al. | 378/131 |
| 3,855,492 | 12/1974 | Langer et al. | 378/125 |
| 3,956,653 | 5/1976 | Lauwaser . | |
| 4,866,748 | 9/1989 | Caraher et al. . | |

*Primary Examiner*—David P. Porta
*Attorney, Agent, or Firm*—Godfrey & Kahn

[57] ABSTRACT

An x-ray tube (10) includes an anode (16), a cylindrical stem (22), and a rotor (24). The rotor (24) includes a cylindrical sleeve portion (32) and a head portion (34) which are joined together at a joint (36). The joint (36) is formed by a mating of a lip (46) in the sleeve portion (32) and a lip (48) in the head portion (34). The lip (48) of the head portion (34) fits about the lip (46) of the sleeve portion (32). The sleeve portion (32) is formed of a first material and the head portion (34) is formed of a second material, the first material having a thermal expansion coefficient greater than that of the second material such that the head portion (34) expands less than the sleeve portion (32) upon heating and thereby maintains the integrity of the joint (36) inasmuch as the head portion (34) overlaps the sleeve portion (32) in the region of the joint (36). The stem (22) is attached to the anode (16) at a first end (50) and attached to the head portion (34) at a second end (52). The stem (22) is attached at the second end (52) by both pipe threaded engagement and by brazing. A shaft (70) is mounted within the interior of the rotor (24) and connected to the head portion (34) by screws (80) having gettering properties. The shaft (70) is supported for rotation by bearings (66), and a collar (74) is incorporated to prevent debris from entering into the bearings (66).

9 Claims, 2 Drawing Sheets

ROTATING ANODE X-RAY TUBE

FIELD OF THE INVENTION

The present invention relates generally to x-ray tubes, and more specifically to x-ray tubes having rotating anodes.

BACKGROUND OF THE INVENTION

Production of an x-ray beam by electron bombardment of a target dates back to the early 1900's. The early x-ray tube consisted of a gas-filled glass envelope containing a cathode and an anode (target). By imposing a high voltage charge between cathode and anode, a glow discharge took place, causing electron bombardment of the target and production of x-ray energy. Later improvements consisted of evacuating the atmosphere around the cathode and anode elements, and the use of a hot tungsten filament within the cathode, permitting the focusing of the electron beam. It was then possible to generate an x-ray beam from a more closely controlled bombardment source, thereby yielding greater diagnostic detail. Finally, a rotating target structure was developed in the early 1940's which permitted a further shrinking of the electron bombardment area, opening up even greater possibilities for improved diagnostic techniques.

Current diagnostic x-ray tubes contain rotating anodes on which targets, which weigh as much as one kilogram, rotate at speeds up to 10,000 rpm. Because of a number of factors, such as thermal expansion and contraction, and high acceleration and deceleration torques, these structures may have a short life due to bearing and unbalance problems. Accordingly, a need has arisen for an x-ray tube structure which has increased structural strength and stability under the extreme operating conditions typical in an x-ray tube.

SUMMARY OF THE INVENTION

In accordance with the present invention, an x-ray tube comprises a rotatable anode, a cylindrical stem, and a rotor structure. The rotor includes a cylindrical sleeve portion and a head portion which are joined to form a joint. The sleeve portion has a first end, a second end which axially opposes the first end, a hollow interior defined by an inside diametral dimension, and an outside boundary defined by an outside diametral dimension. The first end terminates in a lip of reduced outside diametral dimension and the head portion includes a lip which mates with the lip of the sleeve to form the joint, the lip of the head portion fitting about the reduced outside diametral dimension of the lip of the sleeve portion. The sleeve portion is formed of a first material and the head portion is formed of a second material, the first material having a thermal expansion coefficient greater than that of the second material such that the head portion expands less than the sleeve portion upon heating and thereby maintains the integrity of the joint inasmuch as the head portion overlaps the sleeve portion in the region of the joint.

The stem has a first end and an axially opposed second end, the axis of the cylindrical sleeve portion and the axis of the stem being in coaxial arrangement. The anode is fixedly connected to the first end of the stem by a nut. The second end of the stem is pipe threaded and extends into a mating threaded aperture formed in the head portion of the rotor. The stem is attached to the rotor at the aperture by both pipe threaded engagement and by brazing. The combination of the pipe threaded engagement and attachment by brazing of the head portion and the stem provides structural rigidity and lessens the possibility of failure by fatigue. The materials selected for the stem and the head portion also provide structural strength and facilitates machining of the parts. The length of the stem between the first and second ends is selected to be of a length sufficient to provide a convective pathway for dissipation of heat produced by the anode.

A shaft is mounted within the interior of the rotor, the shaft being supported for rotation and the shaft terminating in a plate which is connected to the head portion by axially-directed screws, the screws being formed of a material which has a gettering effect to remove impurities and assist in the creation of a vacuum. The shaft is supported for rotation by bearings and the present invention includes a collar which is positioned to prevent debris from entering into the bearings.

The present invention incorporates structural components which add to the strength and operating stability of the x-ray tube under the extreme operating conditions typical of x-ray tubes, thereby extending the life of the tube. Further objects, features, and advantages of the invention will be apparent from the following detailed description taken in conjunction with the accompanying drawings.

DETAILED DESCRIPTION OF THE PREFERRED EMBODIMENT

Figure 1:
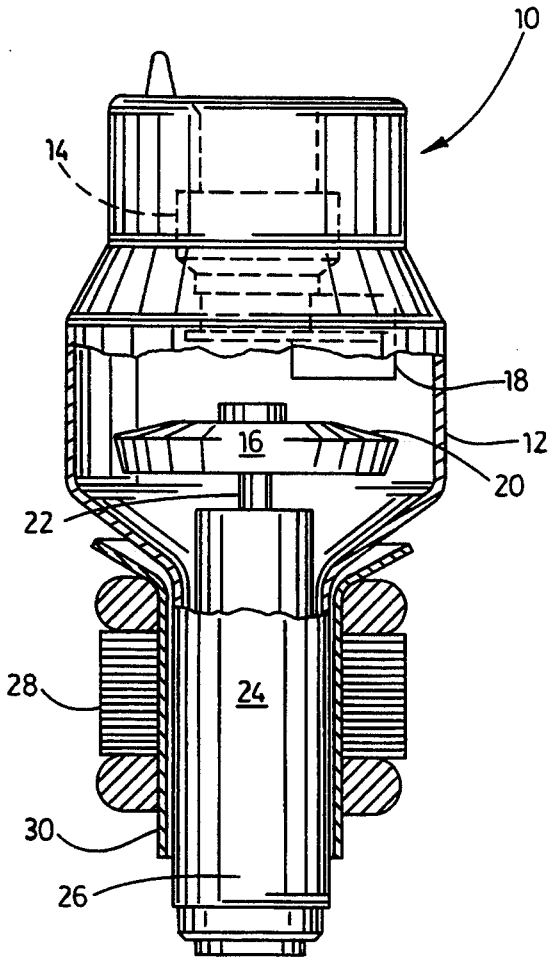
FIG. 1 is an elevational view of a rotating anode x-ray tube with a portion of the glass enclosure broken away to illustrate the rotating anode structure.

With reference to the drawings, FIG. 1 shows an x-ray tube generally indicated at 10 having a glass envelope 12 enclosing a cathode 14 and a rotating anode 16. A tungsten filament 18 is positioned adjacent the cathode 14. The anode 16 is in the form of a disc having a target area 20. The anode 16 is connected through a stem 22 to a hollow cylindrical rotor 24 rotatively mounted within a lower portion 26 of the glass envelope 12. A stator 28 is fixedly mounted about the exterior of the lower portion 26 of the envelope 12. The stator structure 28 is mounted on a cylindrical support structure 30 utilized for supportingly receiving the glass envelope 12.

Figure 2:
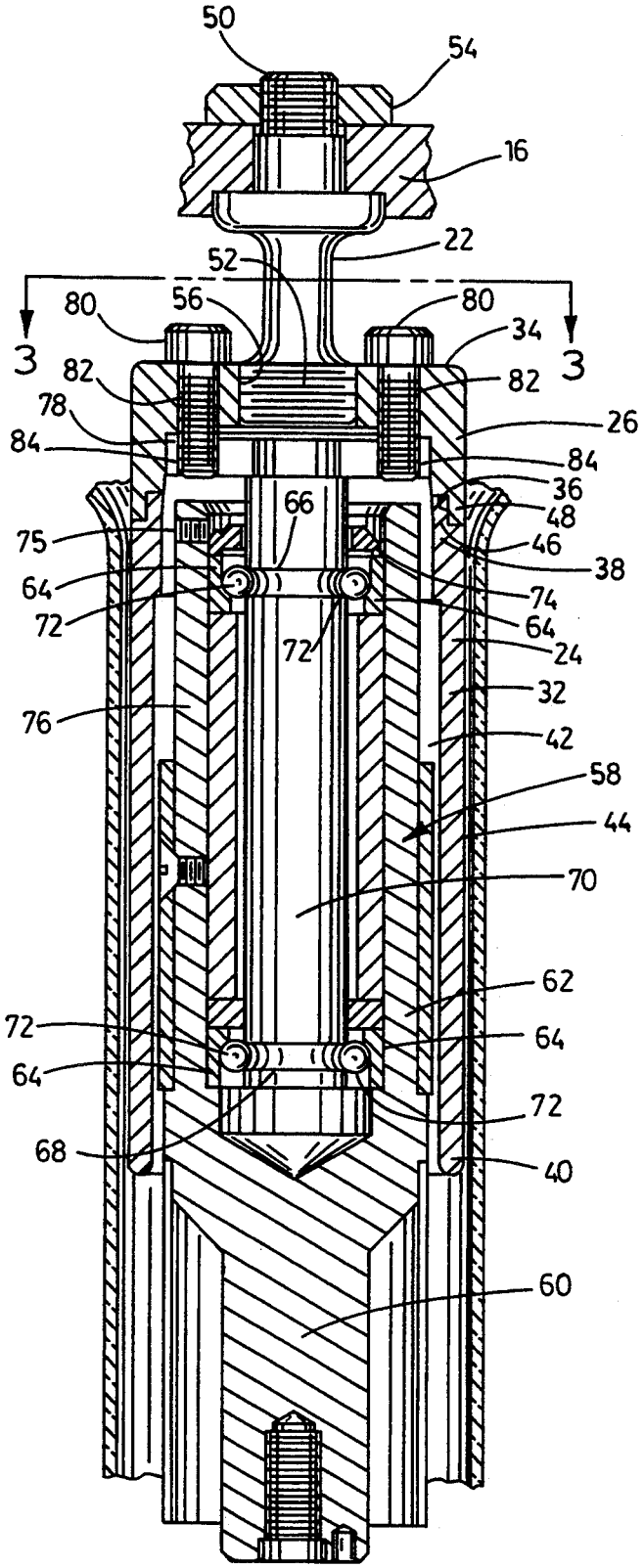
FIG. 2 is an enlarged longitudinal section of the anode shaft and bearing structure in accordance with the present invention.

With reference to FIG. 2, the rotor 24 includes a cylindrical sleeve portion 32 and a head portion 34 which are joined together at a joint 36. The cylindrical sleeve portion 32 has a first end 38, a second end 40 which opposes the first end 38 along the cylindrical axis, a hollow interior 42 defined by an inside diametral dimension, and an outside boundary 44 defined by an outside diametral dimension. The outside boundary 44 terminates in a step or lip 46 of reduced outside diametral dimension at the first end 38. The head portion 34 terminates in a lip 48, the lip 46 and the lip 48 mating with each other to form the joint 36, and the lip 48 of the head portion 34 fitting about the reduced outside diametral dimension of the lip 46 of the sleeve portion 32. The sleeve portion 32 is made of a material which has a thermal expansion coefficient which is greater than the thermal expansion coefficient of the head portion 34 so that upon heating of the joint 36 to the high temperatures typically generated by the x-ray tube 10, the head portion 34 expands less than the sleeve portion 32, which thereby maintains the integrity of the joint 36. A suitable material for the sleeve portion 32 is oxygen-free hydrogenated copper and a suitable material for the head portion 34 is KOVAR ®, a commercially available alloyed metal having nickel and cobalt content. These materials have the thermal expansion properties described above and have properties of structural strength and resistance to fatigue under the conditions which the x-ray tube 10 is operated. The head portion 34 is plated to wet the surface of the head portion 34 for attachment by brazing to the sleeve portion 32 at the joint 36. Where the materials of the sleeve portion 32 and the head portion 34 are copper and KOVAR ®, respectively, a suitable material for plating of the head portion 34 is nickel, and a suitable brazing solder is CUSIL ®, a commercially available solder having copper and silver content.

The stem 22 is cylindrical in configuration, having a first end 50 and an axially opposed second end 52, the axis of the cylindrical sleeve portion 32 and the axis of the stem 22 being in coaxial arrangement. The distance between the first and second ends 50 and 52 is of a length sufficient to provide a convective pathway for dissipation of heat produced by the anode 16. The anode 16 is fixedly connected to the first end 50 of the stem 22 by a nut 54. The second end 52 of the stem 22 is pipe threaded and extends into a mating threaded aperture 56 formed in the head portion 34 of the rotor 24. The stem 22 is attached to the rotor 24 at the aperture 56 by both threaded engagement and by brazing. A suitable material for the stem 22 is TZM ®, a commercially available alloy which comprises about ninety-nine percent molybdenum and fractional percentages of titanium and zirconium. Where the materials of the stem 22 and the head portion 34 of the rotor 24 are TZM ® and nickel-plated KOVAR ®, respectively, a suitable material for plating of the stem 22 is copper, and a suitable brazing solder is PALNIRO ®-7, a commercially available solder having palladium, nickel, and copper content. The above-described materials for head portion 34 of the rotor 24 and the stem 22 are well-suited for the high temperatures generated by the x-ray tube 10. The TZM ® material as selected for the stem 22 provides structural strength and facilitates machining of the part. The combination of the pipe threaded engagement and attachment by brazing of the head portion 34 and the stem 22, provides structural rigidity and lessens the possibility of failure by fatigue. The pipe threaded engagement is preferable in that such threaded engagement bottoms out and tightens on itself.

Figure 3:
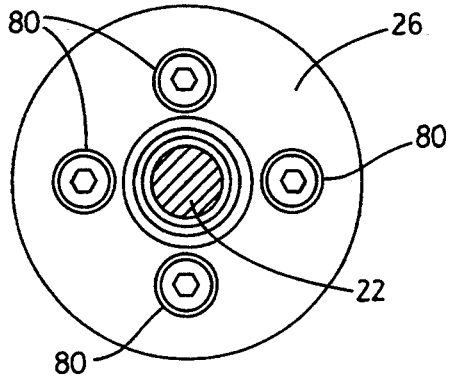
FIG. 3 is a cross-section taken along line 3—3 of FIG. 2.

The anode 16, the stem 22, and the rotor 24 are fixed relative to each other and are collectively mounted upon a bearing and support structure generally indicated at 58. The support structure 58 comprises an elongated base member 60 having an upper cylindrical copper structure 62 for supportingly receiving a pair of outer bearing races 64 of bearings 66. Inner races 68 are created by grooves formed on an anode support shaft 70. A plurality of roller ball bearings 72 are then located within the bearing races 64 and 68. A collar 74 is held in place by three radially-directed set screws 75 which extend through the steel cylinder 76, the collar 74 being positioned to prevent debris from entering the bearings. The set screws 75 put downward force on the bearings 72 and hold the bearings 72 in place. A steel cylinder 76 extends about the cylindrical structure 62 to enhance the motor torque characteristics. The upper end of the anode support shaft 70 is welded to a flange 78, which forms the interconnection and support between the rotating anode structure (the anode 16, the stem 22, and the rotor 24) and the shaft 70. The flange 78 is attached to the interior of the head portion 34 of the rotor 24 by titanium socket head cup screws 80, the heads of which are best viewed in FIG. 3. The selection of titanium is advantageous for its gettering properties, to absorb impurities and assist in the creation of a vacuum within the glass envelope 12. The interior threads of each of the screws 80 extend into a respective mating threaded aperture 82 in the head portion 34 of the rotor 24 and a respective mating threaded aperture 84 in the flange 78. As shown in FIGS. 2 and 3, one of the screws 80 and its respective mating threaded apertures 82 and 84 are in concentric alignment and are oriented parallel to the axis of the stem 22 and the shaft 70. It should also be noted that the shaft 70 forms the inner races 68 of the bearing structure 66, thereby eliminating the need for an inner race. As a result, the bearing shaft 70 can be made of a relatively larger diameter. The above-described arrangement is characterized by stability and rigidity.

Appropriate electrical connectors are provided to permit tube and motor energization. In operation, the stator 28 is activated electrically causing the anode 16 (and target) to rotate. The tungsten filament 18 is lit to an electron emissive temperature, and a high voltage is impressed between the anode 16 and cathode 14. This causes an electron beam to traverse the anode-cathode space, striking the rotating target 20 and generating x-ray energy. In a typical rotating anode x-ray tube, the target temperatures generated may be as high as 1300° C. and rotating at speeds of up to 10,000 rpm. The x-ray tube 10 of the present invention is designed to provide structural strength and stability at such operating temperatures and speeds.

It is to be understood that the invention is not confined to the particular construction and arrangement of parts herein illustrated and described, but embraces such modified forms thereof as come within the scope of the following claims.

What is claimed is:

1. An x-ray tube comprising:

(a) a rotatable anode;

(b) a cylindrical stem oriented along an axis and having a first end and an axially opposed second end, the first end supporting the rotatable anode for rotation about the axis; and (c) a rotor having a cylindrical sleeve portion and a head portion, the sleeve portion being formed of a first material and having a first end, a second end which axially opposes the first end, a hollow interior defined by an inside diametral dimension, and an outside boundary defined by an outside diametral dimension, and wherein the head portion is formed of a second material and the second end of the rotatable stem is attached to the head portion, and further wherein the head portion overlaps the first end of the sleeve portion by fitting about the outside diametral dimension of the head portion to form a joint, and the first material has a thermal expansion coefficient greater than that of the second material such that the head portion expands less than the sleeve portion upon heating and thereby maintaining the integrity of the joint.

2. The x-ray tube of claim 1 wherein the first end of the sleeve terminates in a lip of reduced outside diametral dimension and the head portion includes a lip which mates with the lip of the sleeve to form the joint, the lip of the head portion fitting about the reduced outside diametral dimension of the lip of the sleeve portion.

3. The x-ray tube of claim 1 wherein the material of the sleeve portion is copper.

4. The X-ray tube of claim 1 wherein the material of the head portion is an iron-nickel-cobalt alloy.

5. An x-ray tube comprising:

(a) a rotatable anode;

(b) a cylindrical stem oriented along an axis and having a first end and an axially opposed second end, the first end supporting the rotatable anode for rotation about the axis; and (c) a rotor having a cylindrical sleeve portion and a head portion, the sleeve portion having a first end, a second end which axially opposes the first end, a hollow interior defined by an inside diametral dimension, and an outside boundary defined by an outside diametral dimension, the head portion being joined to the first end of the cylindrical sleeve, and wherein the rotatable stem is attached to the head portion, the stem being attached to the head portion by a combination of direct pipe threaded engagement between the stem and the head portion and brazing.

6. The X-ray tube of claim 5 wherein the material of the stem is a molybdenum alloy which is copper-plated, the material of the head portion is an iron-nickel-cobalt alloy which is nickel-plated, and the brazing material is a gold-nickel-palladium alloy.

7. An x-ray tube comprising:

(a) a rotatable anode;

(b) a cylindrical stem oriented along an axis and having a first end and an axially opposed second end, the first end supporting the rotatable anode for rotation about the axis;

(c) a rotor having a cylindrical sleeve portion and a head portion, the sleeve portion having a first end, a second end which axially opposes the first end, a hollow interior defined by an inside diametral dimension, and an outside boundary defined by an outside diametral dimension, the head portion being joined to the first end of the cylindrical sleeve, and wherein the rotatable stem is attached to the head portion;

(d) a shaft mounted within the interior of the rotor, the shaft being supported for rotation by bearings and the shaft terminating in a plate which is connected to the head portion by axially-directed screws; and (e) a collar which is positioned to prevent debris from entering into the bearings.

8. An x-ray tube comprising:

(a) a rotatable anode;

(b) a cylindrical stem oriented along an axis and having a first end and an axially opposed second end, the first end supporting the rotatable anode for rotation about the axis;

(c) a rotor having a cylindrical sleeve portion and a head portion, the sleeve portion having a first end, a second end which axially opposes the first end, a hollow interior defined by an inside diametral dimension, and an outside boundary defined by an outside diametral dimension, the head portion being joined to the first end of the cylindrical sleeve, and wherein the rotatable stem is attached to the head portion; and (d) a shaft mounted within the interior of the rotor, the shaft being supported for rotation and the shaft terminating in a plate which is connected to the head portion by axially-directed screws, the screws being formed of a material which has a gettering effect.

9. The x-ray tube of claim 8 wherein the material of the screws is titanium.

* * * * *